US011201383B1

(12) United States Patent
Jiang et al.

(10) Patent No.: US 11,201,383 B1
(45) Date of Patent: Dec. 14, 2021

(54) ANTENNA ASSEMBLY

(71) Applicants: ROSENBERGER TECHNOLOGIES CO., LTD., Suzhou (CN); ROSENBERGER TECHNOLOGIES LLC, Budd Lake, NJ (US)

(72) Inventors: Tao Jiang, Suzhou (CN); Dele Wang, Suzhou (CN); Qun Chen, Suzhou (CN); Jun Zhao, Suzhou (CN); Xu Wang, Suzhou (CN); Jing Sun, Suzhou (CN)

(73) Assignees: ROSENBERGER TECHNOLOGIES CO., LTD., Suzhou (CN); ROSENBERGER TECHNOLOGIES LLC, Budd Lake, NJ (US)

( * ) Notice: Subject to any disclaimer, the term of this patent is extended or adjusted under 35 U.S.C. 154(b) by 0 days.

(21) Appl. No.: 17/374,378

(22) Filed: Jul. 13, 2021

(30) Foreign Application Priority Data

Mar. 23, 2021 (CN) ..... 202120586219.X

(51) Int. Cl.
*H01Q 9/04* (2006.01)
*H01Q 1/12* (2006.01)

(52) U.S. Cl.
CPC ..... *H01Q 1/12* (2013.01); *H01Q 9/0407* (2013.01)

(58) Field of Classification Search
CPC ..... H01Q 1/12–1/24; H01Q 1/38; H01Q 9/0407; H01Q 9/28; H01Q 21/24–21/26
See application file for complete search history.

(56) References Cited

U.S. PATENT DOCUMENTS 7,280,082 B2 * 10/2007 Theobold ..... H01Q 1/12 343/770
8,872,715 B2 * 10/2014 Lea ..... H01Q 1/246 343/797
2019/0288406 A1 * 9/2019 Yang ..... H01Q 1/52
2021/0242608 A1 * 8/2021 Semonov ..... H01Q 1/24

* cited by examiner

*Primary Examiner* — Hasan Islam
(74) *Attorney, Agent, or Firm* — Anova Law Group, PLLC

(57) ABSTRACT

An antenna assembly includes a radiation plate, a first feed board, and a second feed board. The radiation plate includes a radiation patch and a plurality of slot members, and each slot member includes a fixing groove and a guide groove communicating with the fixing groove. The first feed board includes a first fixing member at an end facing the radiation patch. The second feed board includes a second fixing member at an end facing the radiation patch, and the second feed board is compatible with the first feed board through a plug-in connection. The fixing grooves of the plurality of slot members respectively match the first fixing member and the second fixing member to realize an in-line cooperation of the radiation plate, the first feed board, and the second feed board.

11 Claims, 10 Drawing Sheets

ANTENNA ASSEMBLY

CROSS-REFERENCE TO RELATED APPLICATION

This application claim priority to Chinese Patent Application No. CN 202120586219.X, filed Mar. 23, 2021, the entire content of which is incorporated herein by reference.

TECHNICAL FIELD

The present disclosure relates to the technical field of antenna and, more particularly, to an antenna assembly.

BACKGROUND

With the needs of social development, mobile communication technology is booming. As the large-scale deployment of Internet of Things and approaching of 5G communication (fifth-generation mobile communication), a new era of Internet of Everything is coming. As one of the most widely used forms in the field of base station antennas, antenna elements account for more than 80% of base stations. With the increasingly updated technology, 5G communication system can meet people's needs for network ultra-large traffic connections, ultra-multiple device connections, and ultra-high mobility with its characteristics of high-speed, large-capacity, and low-latency.

As a carrier of 5G network communication applications, antennas are also advancing with the times following the development of communication technology. However, existing 5G antenna unit has the following defects: 1. Traditional 5G antenna unit is narrow in frequency band, high in cost, and heavy in weight; 2. Traditional 5G antenna unit occupies a large space, which is not conducive to miniaturization of base station antennas; 3. Traditional 5G antenna unit is large in loss; 4. Traditional 5G antenna unit uses a direct feeding structure, which is not conducive to assembly and passive intermodulation will be unstable.

SUMMARY

In accordance with the disclosure, there is provided an antenna assembly including a radiation plate, a first feed board, and a second feed board. The radiation plate includes a radiation patch and a plurality of slot members, and each slot member includes a fixing groove and a guide groove communicating with the fixing groove. The first feed board includes a first fixing member at an end facing the radiation patch. The second feed board includes a second fixing member at an end facing the radiation patch, and the second feed board is compatible with the first feed board through a plug-in connection. The fixing grooves of the plurality of slot members respectively match the first fixing member and the second fixing member to realize an in-line cooperation of the radiation plate, the first feed board, and the second feed board.

BRIEF DESCRIPTION OF THE DRAWINGS

With reference to the accompanying drawings and the following detailed description, the features, advantages, and other aspects of the embodiments of the present disclosure will become more obvious. Here, several embodiments of the present disclosure are shown in an exemplary and non-limiting manner.

DETAILED DESCRIPTION OF THE EMBODIMENTS

Figure 1:
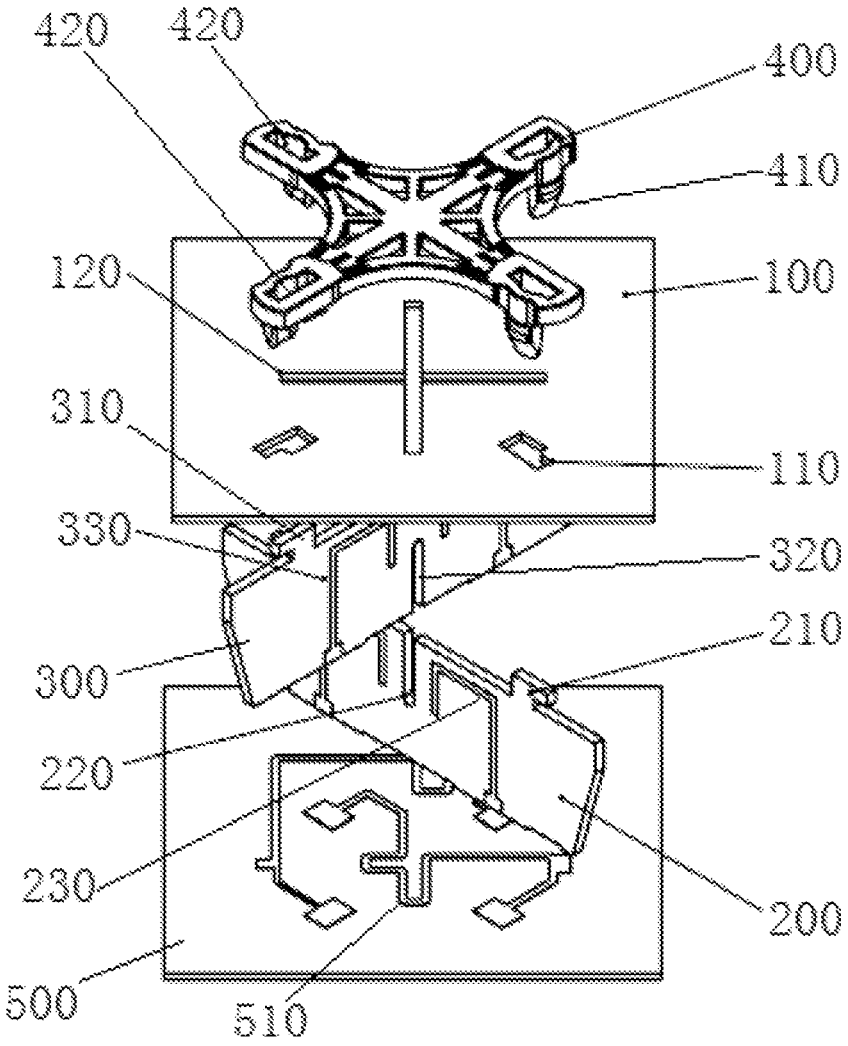
FIG. 1 an exploded view of an example antenna assembly according to one embodiment of the present disclosure.
Figure 2:
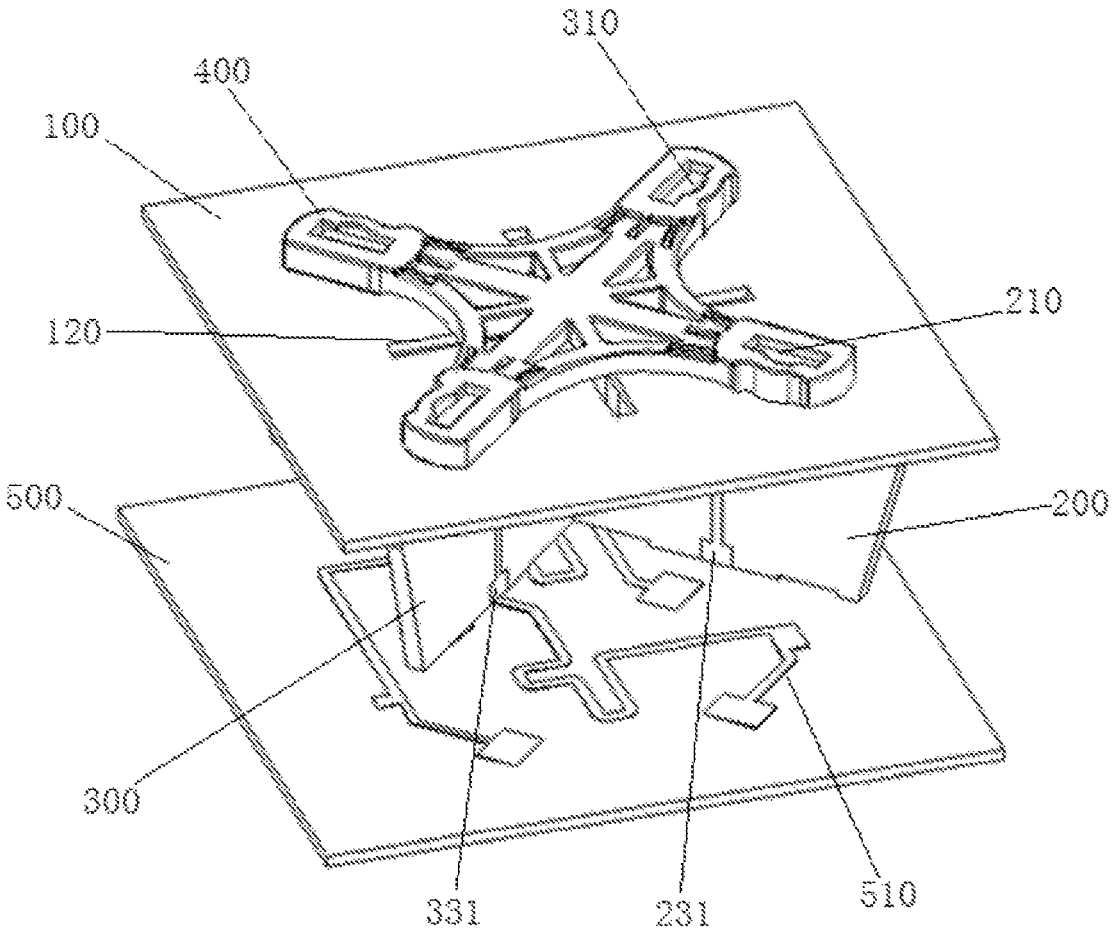
FIG. 2 is a combined view of an example antenna assembly according to one embodiment of the present disclosure.
Figure 3A:
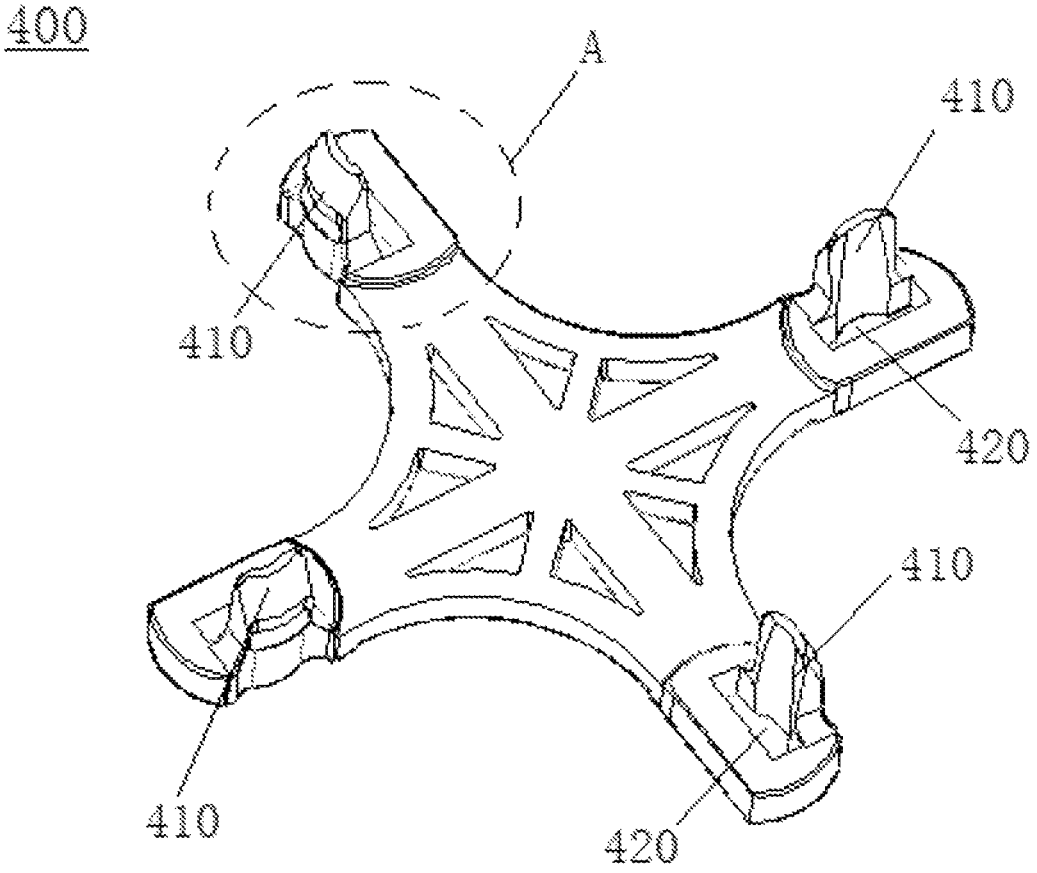
FIG. 3A is a perspective view of a housing of an example antenna assembly according to one embodiment of the present disclosure.
Figure 3B:
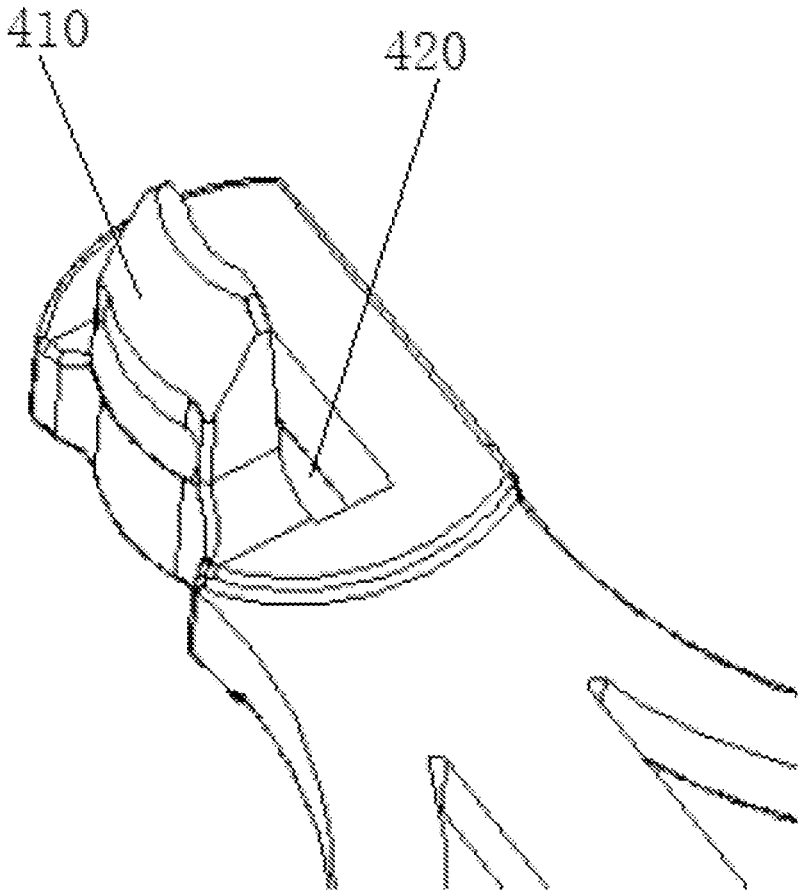
FIG. 3B is a partial enlarged view of part A in the housing shown in FIG. 3A.

The technical solutions of the present disclosure will be further described in detail below through the embodiments and in conjunction with the accompanying drawings. In the specification, the same or similar reference numerals indicate the same or similar components. The following description of the embodiments of the present disclosure with reference to the accompanying drawings is intended to explain the general inventive concept of the present disclosure, and should not be construed as a limitation of the present disclosure.

The terms "include," "including" and similar terms used herein should be understood as open terms, that is, "include/including but not limited to," means that other content may also be included. The term "based on" is "at least partially based on". The term "one embodiment" means "at least one embodiment"; the term "another embodiment" means "at least one additional embodiment", etc.

The embodiments of the present disclosure mainly focus on the following technical issues: how to achieve miniaturization of an antenna assembly, reduce loss, reduce weight, and improve performance stability.

In order to solve the issues described above, an antenna assembly disclosed herein includes: a radiation plate, a first feed board, and a second feed board that is plug-in matching with the first feed board. In other words, the second feed board is compatible with the first feed board through a plug-in connection. The radiation plate is provided with a radiation patch and a plurality of slot members, where each slot member includes a fixing groove and a guide groove communicating with the fixing groove. The first feed board is provided with a first fixing member at an end facing the radiation patch, and the second feed board is provided with a second fixing member at an end facing the radiation patch. The fixing grooves of the plurality of slot members respectively match the corresponding first fixing member and second fixing member, so as to realize an in-line combination of the radiation plate, the first feed board, and the second feed board.

As shown in FIG. 1-6, in an example embodiment, a disclosed antenna assembly includes: a radiation plate 100, a first feed board 200, a second feed board 300, a housing 400, and a reflective plate 500) electrically coupled to the first feed board 200 and the second feed board 300.

Figure 4:
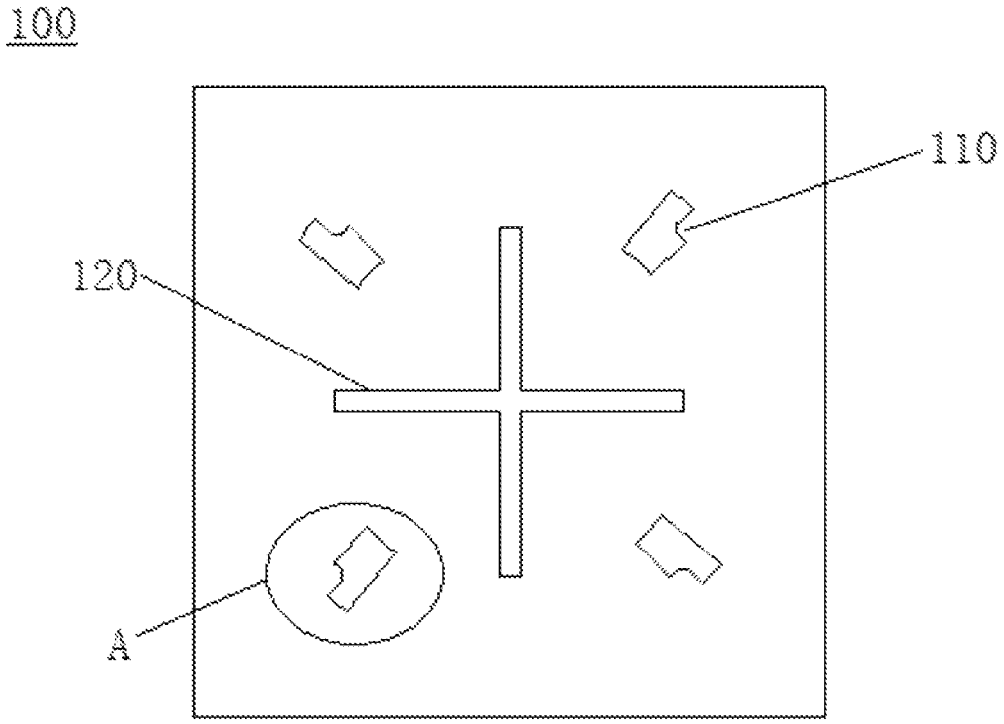
FIG. 4 is a schematic diagram of a radiation plate of an example antenna assembly according to one embodiment of the present disclosure.
Figure 5:
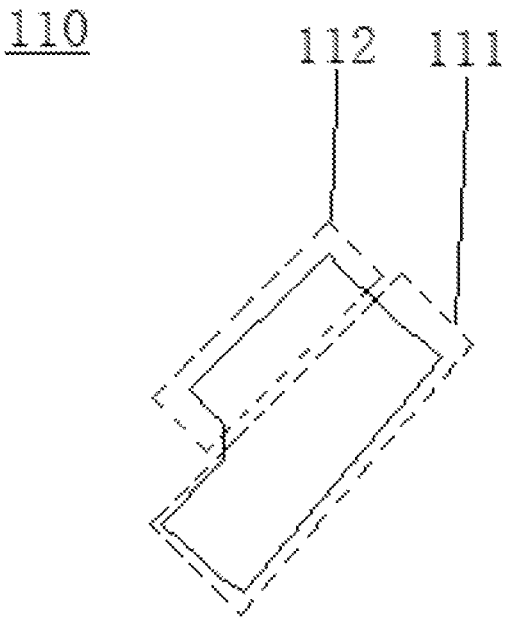
FIG. 5 is an enlarged view of part A in the radiation plate of the example antenna assembly shown in FIG. 4.

Specifically, as shown in FIG. 4, the radiation plate 100 is provided with a radiation patch (not shown), a plurality of slot members 110 and a slot structure 120. In some embodiments, the plurality of slot members 110 are arranged on the radiation plate 100 at intervals symmetrically around the slot structure 120. The slot structure 120 is configured to increase electrical length of a radiator arm of the radiation plate 100, which is beneficial to impedance matching and frequency band adjustment of the antenna assembly. As shown in FIG. 5, each slot member 110 includes a fixing groove 112 and a guide groove 111 communicating with the fixing groove 112.

Figure 6:
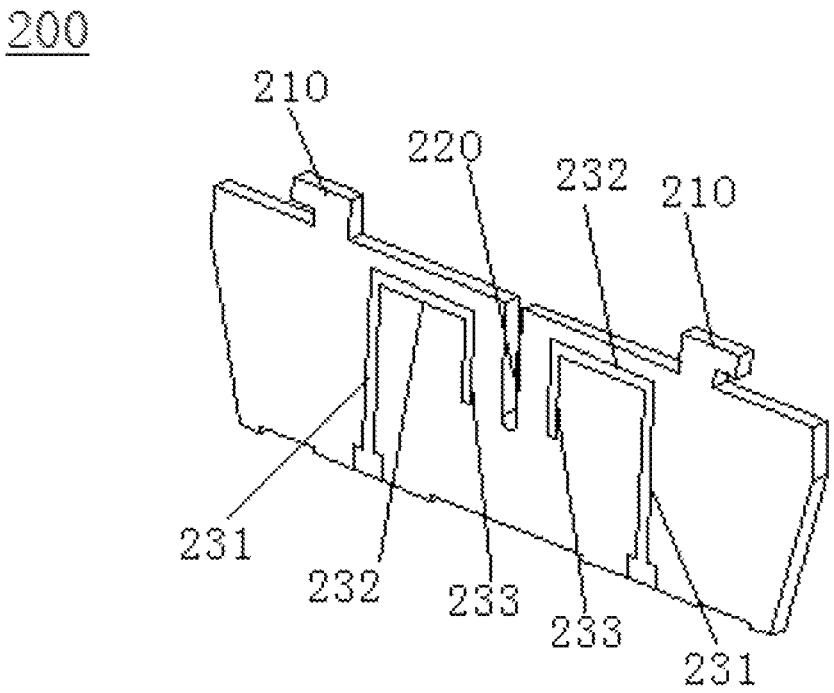
FIG. 6 is a schematic diagram of a first feed board of an example antenna assembly according to one embodiment of the present disclosure.

In addition, as shown in FIGS. 1 and 6, the first feed board 200 is provided with first fixing members 210 and a first groove 220 at an end facing the radiation patch, and the first feed board 200 is provided with a feeding piece 230 thereon. The feeding piece 230 is configured to provide feed to the radiation plate 1W. In some embodiments, two first fixing members 210 are included, but it is understandable that in some other embodiments, the number of the first fixing members 210 can be set as needed.

Figure 8A:
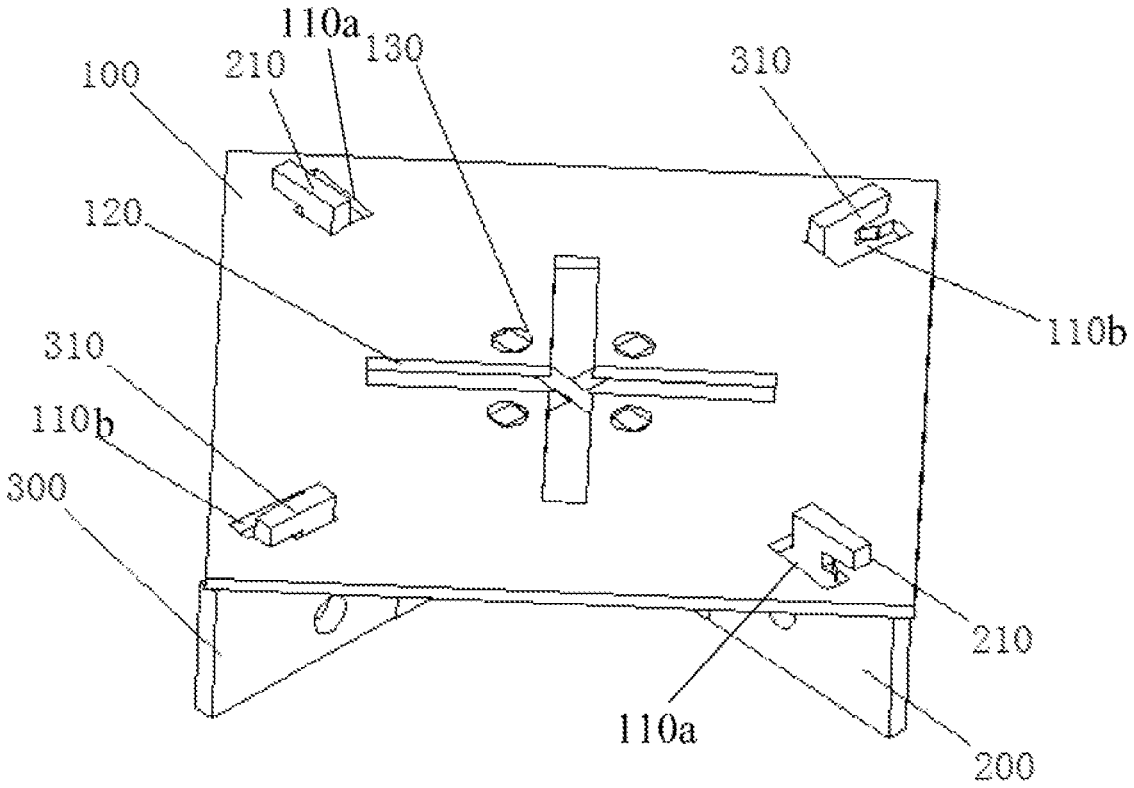
FIG. 8A is a combined view of another example antenna assembly according to one embodiment of the present disclosure.
Figure 8B:
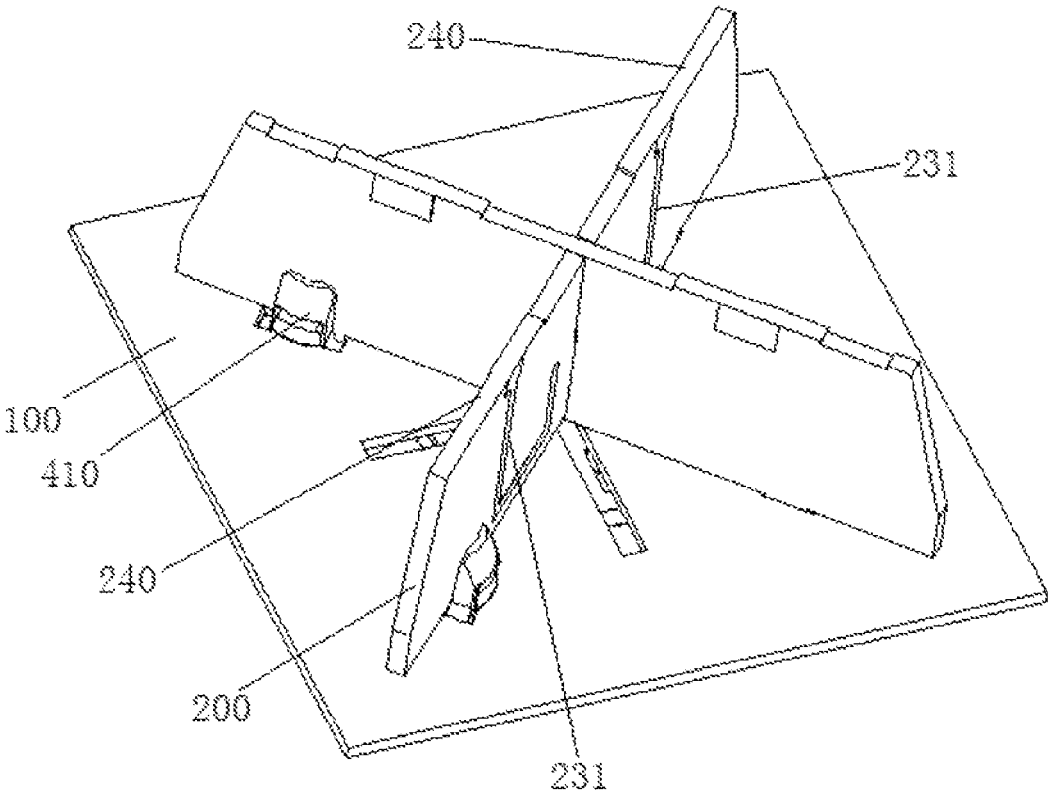
FIG. 8B is another combined view of another example antenna assembly according to one embodiment of the present disclosure.

In some embodiments, as shown in FIGS. 1, 6 and 8B, the feeding piece 230 is in a "U" shape, and the feeding piece 230 includes a connection feeding piece 232, and a short feeding piece 233 and a long feeding piece 231 located at two sides of the connection feeding piece 232. As shown in FIG. 8*b*, the long feeding piece 231 has a rim 240 covering a bottom wall at an end away from the radiation plate 100, so as to be electrically coupled to a feeding network 510 on the reflective plate 500 through the rim 240. The short feeding piece 233 and the connection feeding piece 232 feed signals to the radiation patch of the radiation plate 100 through coupling.

In addition, as shown in FIG. 1, the second feed board 300 is provided with second fixing members 310 at an end facing the radiation patch, and the second feed board 300 is also provided with a second groove 320 and a feeding piece 330 configured to provide feed to the radiation plate 100 at the other end.

In some embodiments, the second groove 320 of the second feed board 3M) matches the first groove 220 of the first feed board 200, so as to realize a plug-in matching of the second feed board 300 and the first feed board 200.

In addition, similar to the first feed board 200 shown in FIG. 6, one or more feeding pieces 330 provided on the second feed board 300 are in a "U" shape. The feeding piece 330 includes a connection feeding piece, and a short feeding piece and a long feeding piece located at two sides of the connection feeding piece. The long feeding piece is electrically coupled to the feeding network 510 on the reflective plate 500, and the short feeding piece and the connection feeding piece feed signals to the radiation patch of the radiation plate 100 through coupling.

In some embodiments, the first feed board 200 and the second feed board 300 are each provided with two feeding pieces, thereby realizing a four-point feeding structure, which is easy to obtain better impedance matching.

In some embodiments, the first feed board 200 and the second feed board 300 are inserted into each other via the first groove 220 and the second groove 320, which can support the reflective plate 500 (such as a PCB plate or a plastic plating plate with a metal structure). Meanwhile, because the first feed board 200 and the second feed board 300 are each provided with the corresponding feeding pieces that are coupled to feed the radiation patch, the disclosed antenna assembly has passive intermodulation stability that is beneficial to an antenna.

In some embodiments, as shown in FIGS. 4 and 5, the size of the fixing groove 112 is smaller than the size of the guide groove 111. In some embodiments, the size of the fixing groove 112 is smaller than the size of the first fixing member 210, and the size of the fixing groove 112 is smaller than the size of the second fixing member 310, so that the fixing groove 112 and the corresponding first fixing member 210 or the corresponding second fixing member 310 have an interference fit.

In addition, as shown in FIGS. 1-3B, the disclosed antenna assembly also includes the housing 400. The bottom of the housing 400 is provided with a plurality of seating grooves 420 and a plurality of buckles, and each seating groove 420 is provided with a buckle 410 at one side. In some embodiments, when the housing 400 is assembled with the radiation plate 100, the first feed board 200, and the second feed board 300, the first fixing member 210 of the first feed board 200 and second fixing members 310 of the second feed board 300 are respectively arranged in the corresponding seating grooves 420.

Specifically, after the first fixing member 210 is inserted into the corresponding slot member 110 via the corresponding guide groove 111, and the second fixing member 310 is inserted into the corresponding slot member 110 via the corresponding guide groove 111, the first fixing member 210 and the second fixing member 310 are respectively in-line combined with the corresponding fixing grooves 112. For example, as shown in FIG. 8A, a slot member 110 corresponding to the first fixing member 210 may be referred as a first slot member 110*a* and a slot member corresponding to the second fixing member 210 may be referred as a second slot member 110*b*. Referring to FIG. 5 and FIG. 8A, after the first fixing member 210 is inserted into the first slot member 110*a* via the guide groove 111 of the first slot member 110*a*, the first fixing member 210 is in-line combined with the fixing groove 112 of the first slot member 110*a* and after the second fixing member 310 is inserted into the second slot member 110*b* via the guide groove 111 of the second slot member 110*b*, and the second fixing member 310 is in-line combined with the fixing groove 112 of the second slot members 110*b*. Further, it can be understood that although FIG. 8A shows two first slot members 110*a* and two second slot members 110*b*, there may be other number of slot members in other embodiments. In addition, after the plurality of slot members 110 are respectively matched with the corresponding first fixing member 210 and the second fixing member 310, the plurality of buckles 410 are respectively matched with the corresponding guide grooves 111, so that the housing 400 and the radiation plate 100 are fixed together with the first feed board 200 and the second feed board 300.

In actual manufacturing process, the plug-in matching between the first fixing member 210 and the second fixing member 310, as well as the in-line matching between the first fixing member 210, the second fixing member 310, and the radiation plate 100 are realized through machinery (for example, a plastic machine).

In some embodiments, since the first feed board, the second feed board, and the radiation plate are coupled together, and a coupled feeding mode is adopted, the disclosed antenna assembly has a high degree of isolation. Meanwhile, the structure of the disclosed antenna assembly is conducive to assembly and use of 50 antennas, thereby enabling a design of broadband 5G antennas. In addition, the disclosed antenna assembly has a simple structure, which is easy and flexible in manufacturing.

As shown in FIGS. 5 and 7-10, in another example embodiment, the disclosed antenna assembly includes: a radiation plate 100, a first feed board 200, a second feed board 300, and a reflective plate 500 electrically coupled to the first feed board 200 and the second feed board 300.

Figure 9:
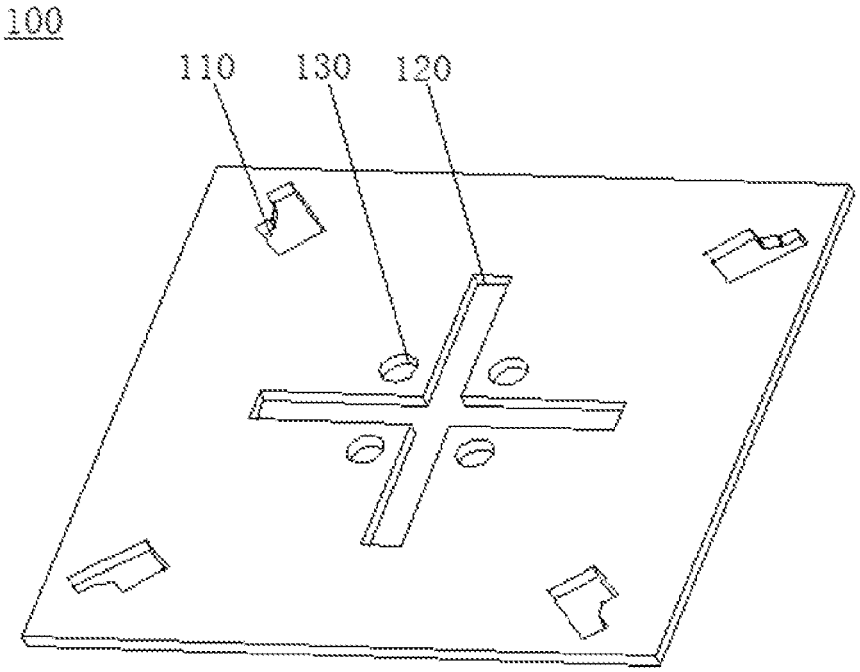
FIG. 9 is a schematic diagram of a radiation plate of another example antenna assembly according to one embodiment of the present disclosure.

Specifically, as shown in FIG. 9, the radiation plate 100 is provided with a radiation patch, a plurality of slot members 110, a slot structure 120 and a plurality of mounting holes 130. As shown in FIG. 5, each slot member 110 includes a fixing groove 112 and a guide groove 111 communicating with the fixing groove 112.

In some embodiments, most of the structures of the first feed board 200 and the second feed board 300 are similar to that of the first feed board 200 and the second feed board 300 disclosed in some embodiments described above. For example, the first feed board 200 is provided with a pair of feeding pieces 230, and the second feed board 300 is provided with a pair of feeding pieces. Each feeding piece is in a "U" shape, and includes: a connection feeding piece 332, and a short feeding piece 333 and a long feeding piece 331 located at two sides of the connection feeding piece 332. As shown in FIG. 8*b*, the long feeding piece 331 has a rim 240 covering a bottom wall at an end away from the radiation plate 100, so as to be electrically coupled to a feeding network 510 on the reflective plate 500 through the rim 240. The short feeding piece 333 and the connection feeding piece 332 feed signals to the radiation patch of the radiation plate 100 through coupling.

Figure 7:
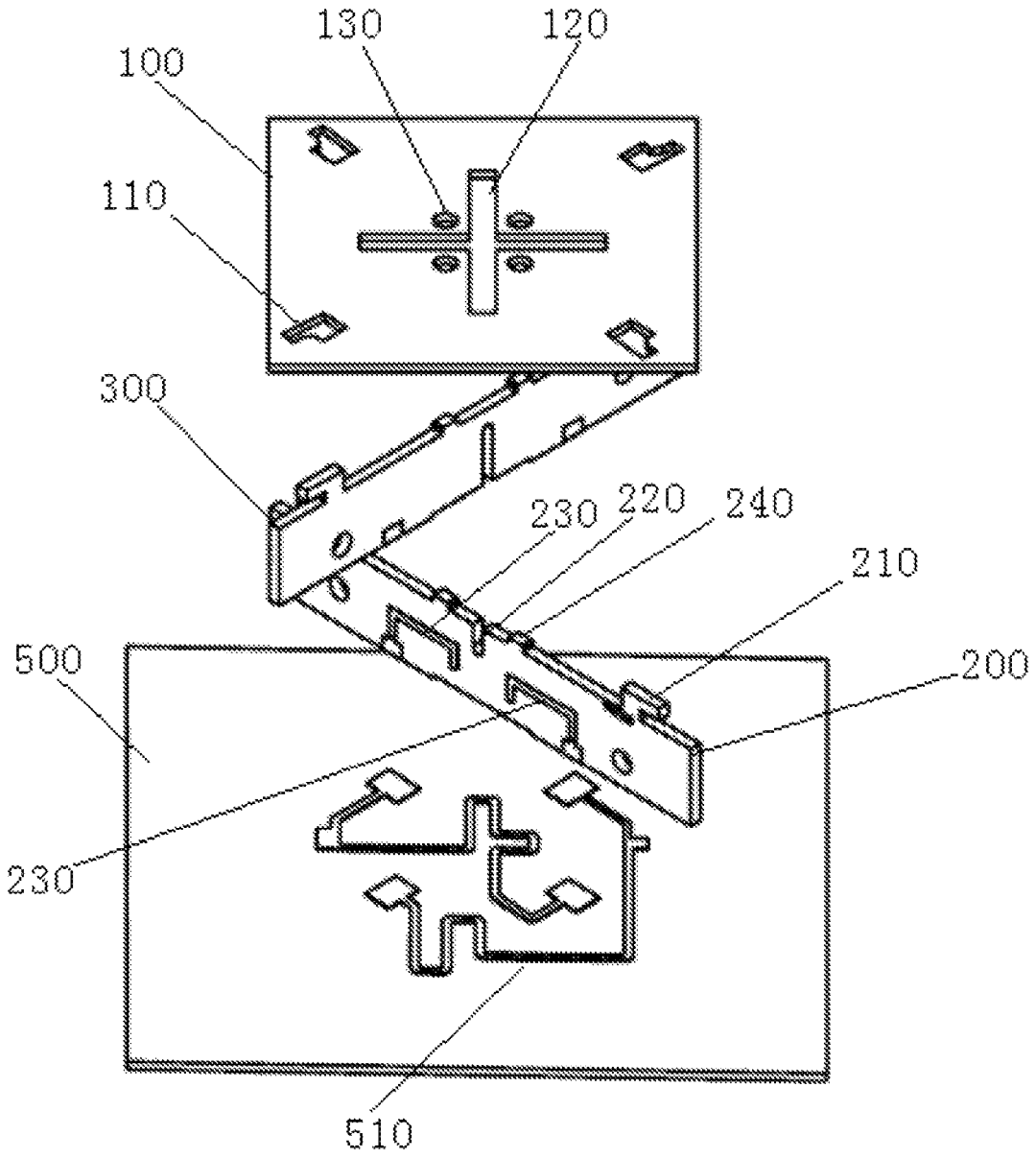
FIG. 7 is an exploded view of another example antenna assembly according to one embodiment of the present disclosure.
Figure 10:
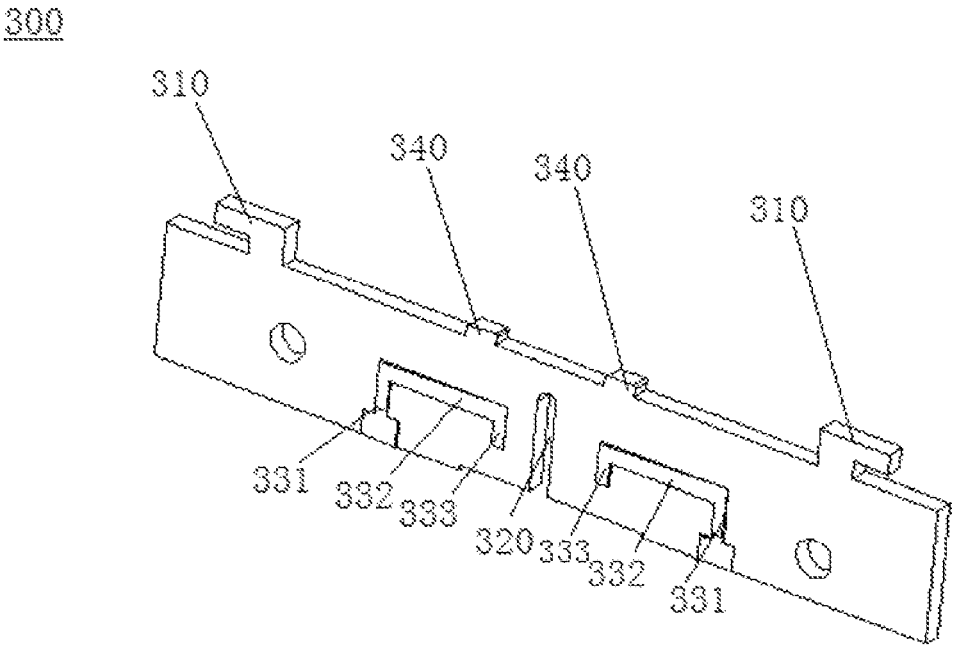
FIG. 10 is a schematic diagram of a second feed board of another example antenna assembly according to one embodiment of the present disclosure.

In addition, as shown in FIGS. 7 and 10, in some embodiments, the first feed board 200 is also provided with first rotation shafts 240 at an end facing the radiation patch, and the second feed board 300 is also provided with second rotation shafts 340 at an end facing the radiation patch. The plurality of mounting holes 130 are respectively matched with the corresponding first rotation shafts 240 and the second rotation shafts 340.

In some embodiments, after the first fixing member 210 is inserted into the corresponding slot member 110 via the corresponding guide groove 111, and the second fixing member 310 is inserted into the corresponding slot member 110 via the corresponding guide groove 111, the plurality of mounting holes 130 are matched with the corresponding first rotation shafts 240 and the second rotation shafts 340, and the first feed board 200 and the second feed board 30) are rotated, so that the first rotation shafts 240 and the second rotation shafts 340 rotate in the corresponding mounting holes 130, and the first fixing member 210 and the second fixing member 310 respectively enter the corresponding fixing groove 112. In other words, after the first fixing member 210 is inserted into the first slot member 110*a* via a guide groove 111 of the first slot member 110*a*, the first feed board 200 is rotated to make the first fixing member 210 enter a fixing groove 112 of the first slot member 110*a*; and after the second fixing member 310 is inserted into a second slot member 110*b* via a guide groove 111 of the second slot member 110*b*, the second feed board 300 is rotated to make the second fixing member 310 enter a fixing groove 112 of the second slot member 110*b*.

Compared with some embodiments described above, the antenna assembly disclosed in some other embodiments also uses a coupling feeding structure to expand working bandwidth of the antenna assembly, which has a high degree of isolation, and is beneficial to the impedance matching and frequency band adjustment of the antenna assembly. Meanwhile, because there is no need to use a housing to further strengthen the radiation plate, the first feed board, and the second feed board, the antenna assembly structure is more compact and miniaturized, which is more conducive to the assembly and use of antenna (especially 5G antenna).

The foregoing descriptions are only some embodiments of the present disclosure, and are not used to limit the embodiments of the present disclosure. For those skilled in the art, the embodiments of the present disclosure may have various modifications and changes. Any modification, equivalent replacement, improvement, etc. made within the spirit and principle of the embodiments of the present disclosure should be included in the scope of the embodiments of the present disclosure.

Although the embodiments of the present disclosure have been described with reference to several specific embodiments, it should be understood that the embodiments of the present disclosure are not limited to the specific embodiments disclosed. The embodiments of the present disclosure are intended to cover various modifications and equivalent arrangements included within the spirit and scope of the appended claims. The scope of the appended claims accords with the broadest interpretation, so as to include all such modifications and equivalent structures and functions.

What is claimed is:

1. An antenna assembly comprising:

a radiation plate including a radiation patch and a plurality of slot members, each slot member including a fixing groove and a guide groove communicating with the fixing groove;

a first feed board including a first fixing member at an end facing the radiation patch; and a second feed board including a second fixing member at an end facing the radiation patch, the second feed board being compatible with the first feed board through a plug-in connection;

wherein:

the fixing grooves of the plurality of slot members respectively match the first fixing member and the second fixing member to realize an in-line cooperation of the radiation plate, the first feed board, and the second feed board.

2. The antenna assembly of claim 1, wherein after the first fixing member is inserted into a first slot member via a first guide groove of the first slot member, the first fixing member is in-line with the fixing groove of the first slot member; and after the second fixing member is inserted into a second slot member via a second guide groove of the second slot member, the first fixing member and the second fixing member is in-line with the fixing groove of the second slot member.

3. The antenna assembly of claim 1, further comprising:

a housing, a bottom of the housing being provided with a plurality of seating grooves and a plurality of buckles, each buckle being located at one side of the corresponding seating groove;

wherein after the plurality of slot members are respectively matched with the corresponding first fixing member and the second fixing member, the plurality of buckles are respectively matched with the corresponding guide grooves, and the plurality of seating grooves are matched with the corresponding first fixing member or the second fixing member to cause the housing and the radiation plate are fixed together with the first feed board and the second feed board.

4. The antenna assembly of claim 1, wherein a size of the fixing groove is smaller than a size of the guide groove.

5. The antenna assembly of claim 1, wherein the radiation plate is provided with a slot structure, the plurality of slot members are arranged on the radiation plate around the slot structure.

6. The antenna assembly of claim 1, wherein the first feed board and the second feed board are each provided with a feeding piece configured to provide feed to the radiation plate.

7. The antenna assembly of claim 6, wherein:

the feeding piece has a "U" shape;

the feeding piece includes a connection feeding piece, and a short feeding piece and a long feeding piece located at two sides of the connection feeding piece;

the long feeding piece is electrically connected to a feeding network; and the short feeding piece and the connection feeding piece feed signals to the radiation patch through coupling.

8. The antenna assembly of claim 1, wherein:

the first feed board is provided with a first groove;

the second feed board is provided with a second groove; and the second groove matches the first groove to realize a plug-in matching of the second feed board and the first feed board.

9. The antenna assembly of claim 1, wherein the plurality of slot members are arranged symmetrically on the radiation plate at intervals.

10. The antenna assembly of claim 1, wherein:

a size of the fixing groove is smaller than a size of the first fixing member; and the size of the fixing groove is smaller than a size of the second fixing member.

11. The antenna assembly of claim 1, wherein:

the first feed board is further provided with a first rotation shaft at an end facing the radiation patch;

the second feed board is further provided with a second rotation shaft at an end facing the radiation patch;

the radiation plate is further provided with a plurality of mounting holes respectively matching with the first rotation shaft and the second rotation shaft;

after the first fixing member is inserted into a first slot member via a guide groove of the first slot member, the first feed board is rotated to make the first fixing member enter a fixing groove of the first slot member; and after the second fixing member is inserted into a second slot member via a guide groove of the second slot member, the second feed board is rotated to make the second fixing member enter a fixing groove of the second slot member.

* * * * *